US005787669A

United States Patent [19]

Bishop

[11] Patent Number: 5,787,669

[45] Date of Patent: Aug. 4, 1998

[54] BUILDING COMPONENTS

[76] Inventor: Chester Oliver Bishop, 218 Don Buck Road, Auckland, New Zealand

[21] Appl. No.: 750,083

[22] PCT Filed: Jun. 8, 1995

[86] PCT No.: PCT/NZ95/00053

§ 371 Date: Dec. 19, 1996

§ 102(e) Date: Dec. 19, 1996

[87] PCT Pub. No.: WO95/33902

PCT Pub. Date: Dec. 14, 1995

[30] Foreign Application Priority Data

Jun. 9, 1994 [NZ] New Zealand ..... 260714

[51] Int. Cl.[6] ..... E04B 2/08

[52] U.S. Cl. ..... 52/591.4; 52/578; 52/591.1

[58] Field of Search ..... 52/578, 563, 567, 52/599, 604, 588.1, 589.1, 590.2, 591.1, 591.3, 592.2, 591.4, 591.5, 592.1, 592.3, 384

[56] References Cited

U.S. PATENT DOCUMENTS

| | | | |
|---|---|---|---|
| 752,697 | 2/1904 | McCarrell | 52/591.1 X |
| 1,379,636 | 5/1921 | Lydon | 52/591.5 X |
| 1,843,024 | 1/1932 | Fetz | 52/591.1 |
| 2,649,172 | 8/1953 | Allen | 52/591.4 |
| 3,987,599 | 10/1976 | Hines | 52/591.1 |
| 4,095,388 | 6/1978 | Breault | 52/591.1 X |

FOREIGN PATENT DOCUMENTS

| | | | |
|---|---|---|---|
| 332606 | 2/1921 | Germany | 52/591.1 |
| 2135980 | 2/1973 | Germany | 52/578 |
| 187466 | 8/1991 | Japan | 52/578 |

*Primary Examiner*—Creighton Smith
*Attorney, Agent, or Firm*—Young & Thompson

[57] ABSTRACT

A building block (10) of the type which can be used to construct a structure made up of a number of identical such blocks disposed side to side. The blocks are usually square although triangular blocks may be used in conjunction therewith. The preferred form of the square block is provided with four flat sides including parallel first (14) and second (18) sides and parallel third (16) and fourth (12) sides. Two flanges (42, 40) extend along the respective first and third sides, projecting outwardly therefrom. Two recesses (60, 49) shaped complementarily to the flanges extend along the respective second and fourth sides, projecting inwardly therefrom. The first flange intersects the second flange adjacent the junction between the first side and the third side. At their opposite ends the flanges comprise triangular portions (54, 66) which span the respective recesses and are provided with indentations in their outer faces which are aligned with the recesses. Adjacent the junction (20) between the second side and the fourth side, the recesses intersect and comprise a common indentation (70) which receives the indented triangular portions of the flanges of adjacent blocks in the structure. The form of the blocks ensures that all interfaces between blocks laid adjacent one another in a structure are covered by the flanges. For a wall structure, the blocks are preferably laid with the sides at 45° to the horizontal. Blocks of polygonal shapes are also envisaged.

20 Claims, 7 Drawing Sheets

FIG. 10
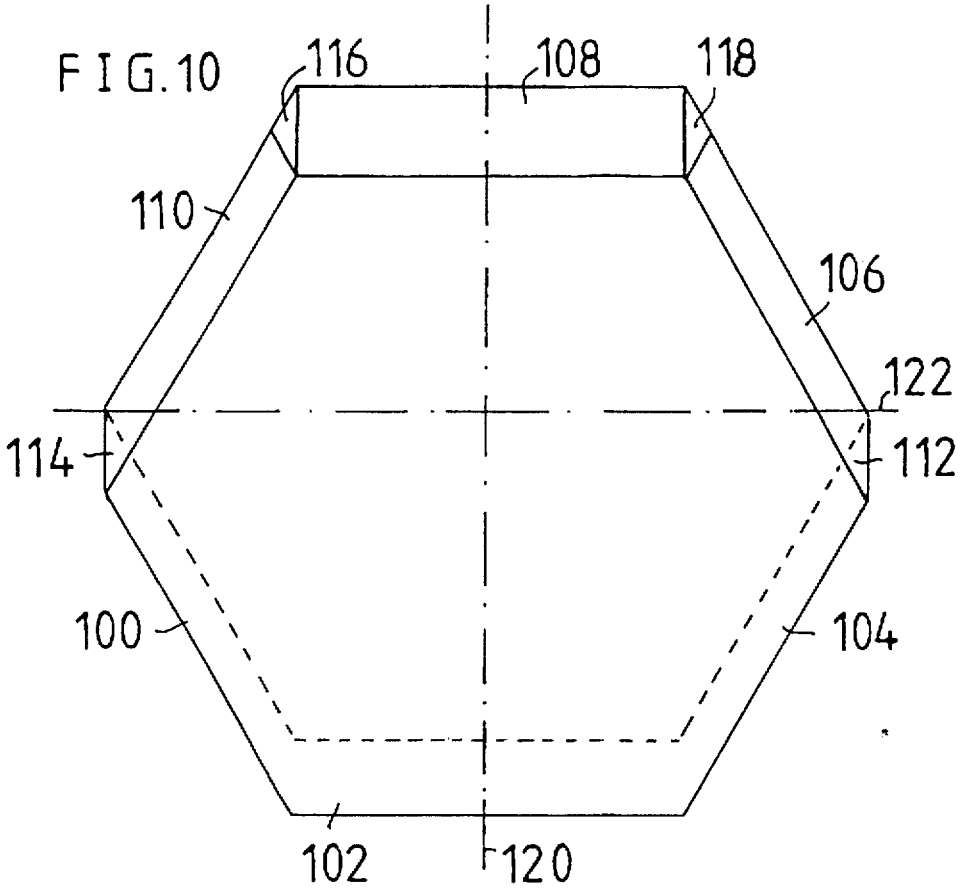
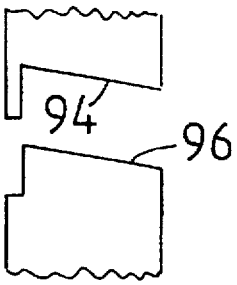
FIG. 7
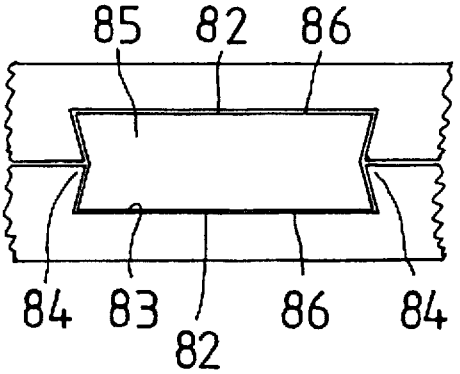
FIG. 8

BUILDING COMPONENTS

FIELD OF THE INVENTION

This invention relates to building components for the construction of walls and other structures, and it more particularly relates to pre-formed modular building blocks for such structures.

BACKGROUND OF THE INVENTION

There are a number of construction methods in which modular building components are used. Modular components are used in the construction of walls in particular, although they are also used in the construction of roofs or floors. Amongst the earliest examples of modular blocks were bricks of sun-dried clay or mud. These were followed in turn by shaped stone blocks, fired clay bricks and concrete blocks.

Although all of these elements are still in wide use today, they exhibit a variety of disadvantages including the fact that they are often heavy, brittle and of small size, all of which increase handling costs. Transport costs are also significant for such elements.

Furthermore, the constructions in which such elements are used are relatively prone to damage by earthquakes. In geographical areas such as New Zealand in which earthquakes are common, such constructions need to be reinforced by means of rods of reinforcing steel, or the like.

In addition, in constructions in which the bricks and other such elements are laid in horizontal courses, it is common for dampness problems to occur due to the fact that rain and moisture to which the construction is exposed is not easily able to drain away.

OBJECT OF THE INVENTION

It is an object of the invention to provide a modular building block having a novel form and in particular a novel means for helping to prevent the penetration of water past the outer face of a construction in which a number of the blocks are disposed side to side with other blocks to which they are joined.

SUMMARY OF THE INVENTION

According to the invention there is provided a building block comprising spaced apart first and second sides and spaced apart third and fourth sides which are disposed transversely to the first and second sides, the block being of the type which can be used to construct a structure in which a number of the blocks are disposed side to side with other blocks to which they are joined, characterised in that the block comprises

- a first flange which extends along the first side and projects outwardly therefrom away from the second side,
- a second flange which extends along the third side and projects outwardly therefrom away from the fourth side,
- a first recess which extends along and adjoins the second side, projecting inwardly therefrom towards the first side and being shaped complementally to the first flange, and
- a second recess which extends along and adjoins the fourth side, projecting inwardly therefrom towards the third side and being shaped complementally to the second flange.

In one form of the invention the first and second sides of the block are mutually parallel and the third and fourth sides are mutually parallel and are disposed at right angles to the third and fourth sides. The invention has particular application to a block in which the sides are of substantially equal length so that the sides are disposed in a substantially square configuration. Advantageously, the sides are also substantially flat.

According to an important aspect of the invention, the block is substantially symmetrical about an imaginary plane of symmetry which is located between the first and fourth sides and the third and second sides.

In one form of the invention the first flange intersects the second flange at a position located outwardly of a junction between the first side and the third side. Furthermore adjacent a junction between the first side and the fourth side, the first flange comprises a portion which spans the second recess and has an outer face in which an indentation is formed which is aligned with the second recess. And still further, adjacent ajunction between the second side and the third side, the second flange comprises a portion which spans the first recess and has an outer face in which an indentation is formed which is aligned with the first recess.

The block will usually have an outer wall extending between the first and second sides and between the third and fourth sides. In such a case the flanges advantageously comprise outer faces a portion of each of which is coplanar with an outer face of the block.

The invention has particular utility in a block in which the flanges and the recesses are of substantially equal length and are disposed at right angles to one another in a substantially square configuration. In one aspect of the invention, in a block of this form, the portion of the first flange which spans the second recess has an outer edge which is located in or inside an imaginary plane which passes through the junction between the first side and the fourth side and intersects the first side at an angle of 45°, and the portion of the second flange which spans the first recess has an outer edge which is located in or inside an imaginary plane which passes through the junction between the second side and the third side and intersects the third side at an angle of 45°. Advantageously therefore, a portion of the outer edge of the first flange is parallel to the first side and intersects the portion which spans the second recess at an angle of 135°, and a portion of the outer edge of the second flange is parallel to the third side and intersects the portion which spans the second recess at an angle of 135°.

According to another important aspect of the invention, adjacent a junction between the second side and the fourth side, the recesses intersect at a zone in which they comprise a common indentation which has a depth which is at least equal to the depth of the portions of the flanges which span the first and second recesses.

In one form of the invention, the first and second flanges are respectively located adjacent outer edges of the first and third sides and that the block comprises a third flange which is spaced from the first flange and extends along the first side portion, projecting outwardly therefrom away from the second side, and a fourth flange which is spaced from the second flange and extends along the third side, projecting outwardly therefrom away from the fourth side.

Advantageously, the third flange is located adjacent an inner edge of the first side and the fourth flange is located adjacent an inner edge of the third side. Furthermore, the third flange is parallel to the first flange and the fourth flange is parallel to the second flange. Preferably, the third flange and the fourth flange have inner faces which are coplanar.

In one form of the invention the block comprises a cavity defined by outer walls disposed about the periphery of the block and having outer faces constituting the sides of the block. Advantageously the cavity is spanned by at least one pair of inner walls having flat inner faces with a gap therebetween which is disposed diagonally across the cavity.

Blocks having substantially flat sides can be joined together by gluing. However, in one alternative, formations may be provided in the first side and the second side which are shaped and positioned so that, when the first side of the block is face to face with the second side portion of an identical block, the formations interengage to join the blocks together. Similar such formations may be provided in the third and fourth sides.

In a second alternative, formations may be provided in the first side and the second side which are shaped and positioned so that, when the first side of the block is face to face with the second side portion of an identical block, the formations are in register and a joining member can be inserted therein which joins the blocks together. Again, similar such formations may be provided in the third and fourth sides.

The block may be formed from any suitable material including cement and clay or other ceramic. It is however considered that the block may be advantageously manufactured from recycled plastics material. Accordingly, the invention provides that the block is of a moulded plastics material.

BRIEF DESCRIPTION OF THE DRAWINGS

The invention will be further discussed with reference to the accompanying drawings in which various aspects thereof are shown by way of example and in which:

FIG. 7 is a fragmentary view of two blocks, one with a modified flanged side wall and the other with a recess adjoining a complementarily modified side wall;

FIG. 8 is a second fragmentary view of two blocks with modified side walls joined together by a keying element; FIG. 10 is a plan view of a hexagonally shaped block.

DESCRIPTION OF PREFERRED EMBODIMENT

Figure 1:
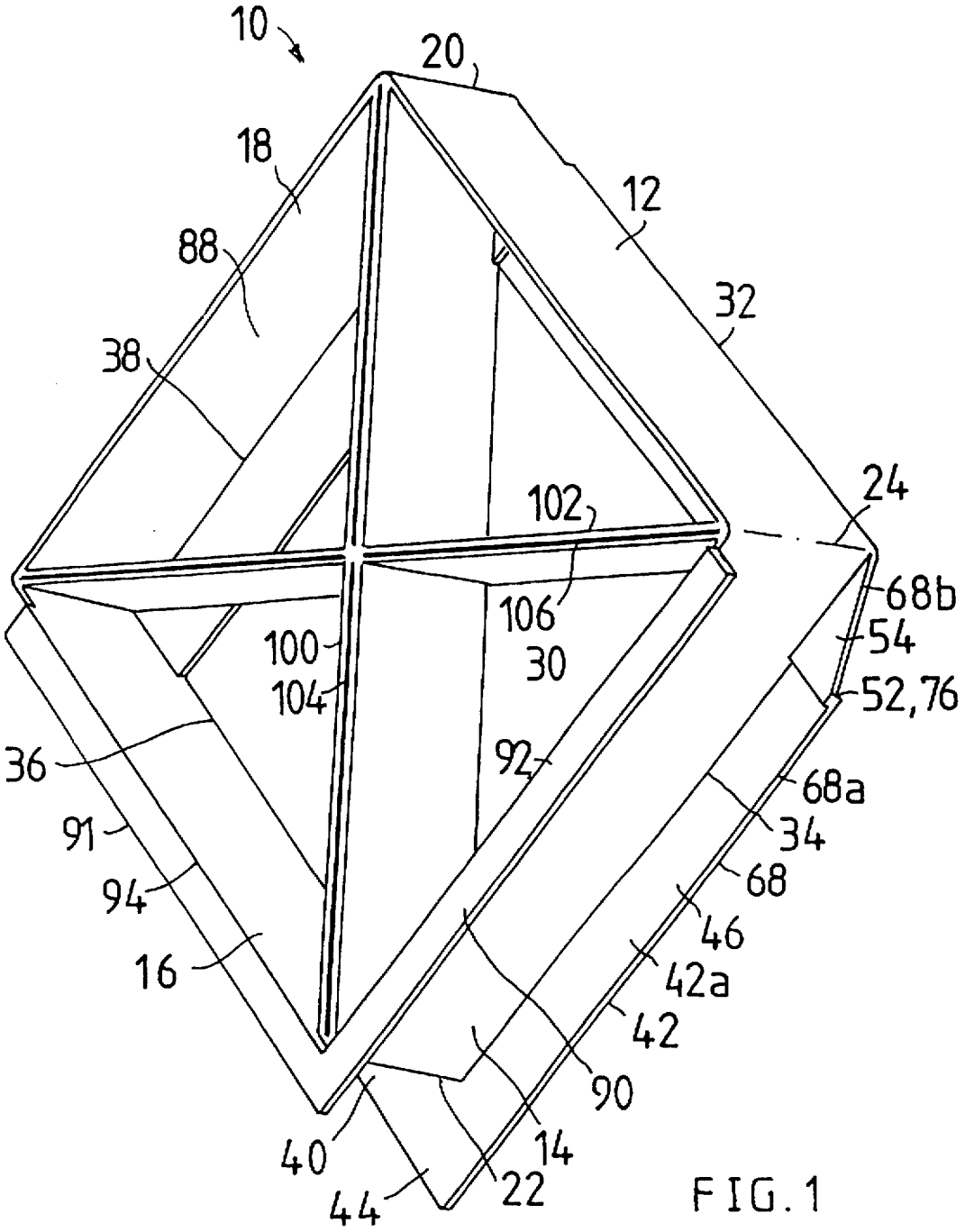
FIG. 1 is a somewhat schematic illustration of a modular building block of the present invention viewed from an inner side thereof.
Figure 2:
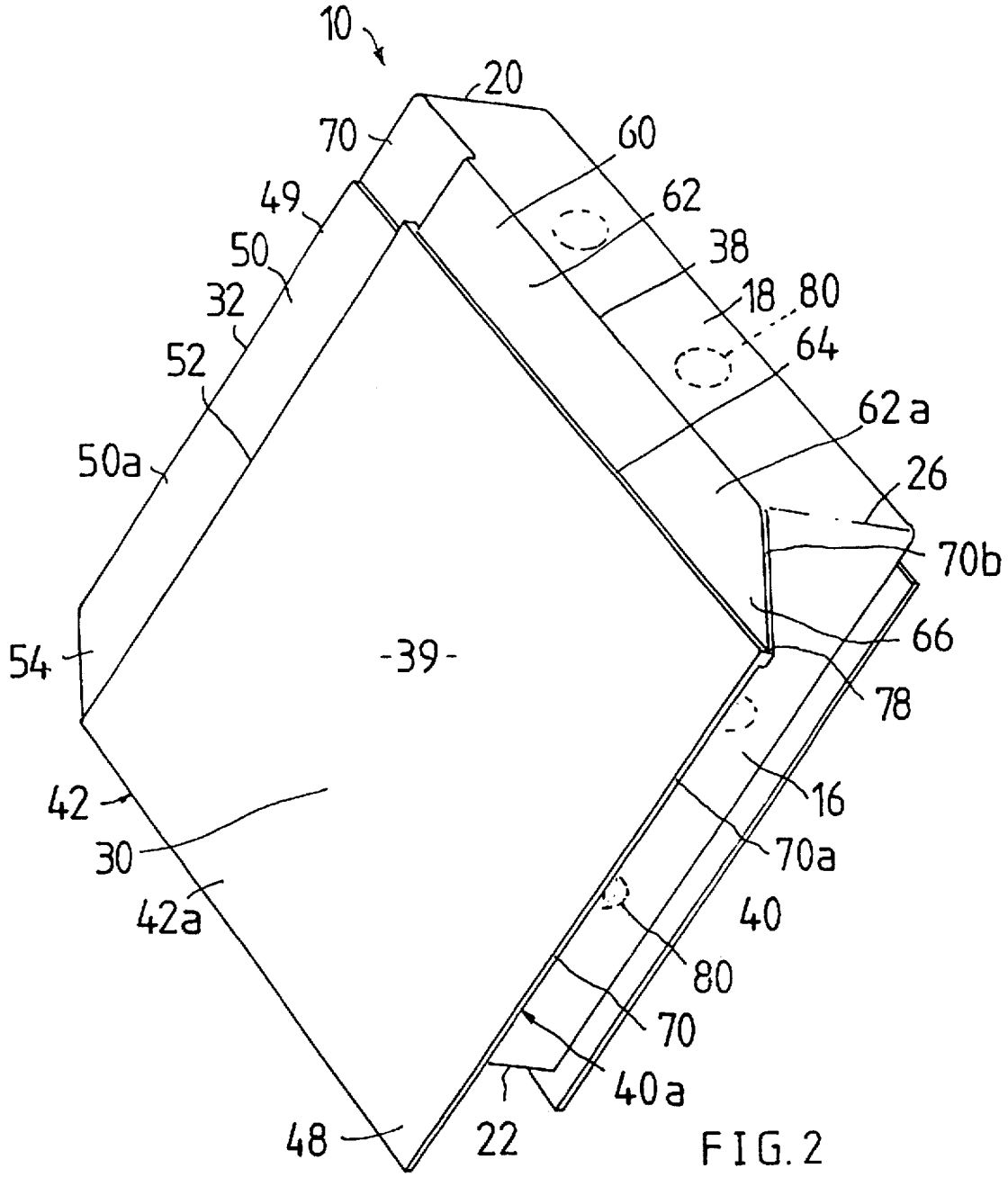
FIG. 2 is an illustration, also somewhat schematic, of the building block shown in FIG. 1, viewed from an outer side thereof.

Referring first to FIGS. 1 and 2, there is shown a block 10 comprising four side walls 12, 14, 16, 18. In the present example the side walls are flat. Each is substantially rectangular. All are of substantially the same size. The walls 12, 16 are mutually parallel and spaced apart from one another by the walls 14, 18 which are also mutually parallel. The two walls 12, 18 intersect along a junction line 20. The other two walls 14, 16 intersect along a second junction line 22. Similarly the walls 12, 14 and 16, 18 intersect along junction lines 24, 26. The junction lines are mutually parallel. The block thus has the shape of a box having four side walls and a square cross section.

A cross wall 30 joins the outer edges 32, 34, 36, 38 of the side walls 12, 14, 16, 18 respectively. The cross wall has an outer face 39 which, in the present case, is substantially flat and disposed at right angles to the side walls. The cross wall terminates at the outer edges 32, 38. However, a flange 40 projects outwardly from the outer edge 36 of the wall 16 away from the wall 12. Similarly, a second flange 42 projects outwardly from the outer edge 34 of the wall 14 away from the wall 18. In the present case both flanges 40, 42 form extensions of the cross wall and thus have flat outer faces which are continuous with the face 39 of the cross wall 30. The flanges 40, 42 also have inner faces 44, 46 which are substantially flat, coplanar and substantially parallel to the outer face 39. The inner faces 44, 46 respectively adjoin the outer faces of the walls 16, 14.

The flange 42 extends along the entire length of the side wall 14—at one end it terminates at the side wall 12 and at the opposite end it comprises a portion 48 which projects beyond the side wall 16. Similarly, the flange 40 extends along the entire length of the side wall 16—at one end it terminates at the side wall 18 and at the opposite end it projects beyond the wall 14 and it intersects the portion 48.

Adjacent the side wall 12 a first recess 49 is formed in the cross wall 30. The recess 49 takes the form of an indentation in the outer face 39 of the cross wall comprising a face 50 which, along one edge, adjoins the wall 12 and, along the opposite edge, adjoins a shoulder 52 which itself adjoins the outer face 39. The recess adjoins the wall 12 along the entire length thereof—at one end it terminates at the side wall 18 and at the opposite end it extends past the wall 14 and across the flange 42. The flange 42 thus comprises a portion 54 which incorporates the end of the recess 49. To accomplish this the outer face of the flange is stepped or indented so that, at the portion 54, it is level with (and intersects) the face 50 of the recess 49.

Similarly, adjacent the wall 18 a second recess 60 is formed in the cross wall 30. The recess 60 is substantially similar to the recess 49, comprising a face 62 which, along one edge, adjoins the wall 18 and, along the opposite edge, adjoins a shoulder 64 which itself adjoins the outer face 39 of the cross wall. The recess 60 adjoins the wall 18 along the entire length thereof—at one end it terminates at the side wall 12 and at the opposite end it extends past the wall 16 and across the flange 40. Again, the outer face of the flange 40 is indented or stepped at an end portion 66 where it is level with (and intersects) the face 62 of the recess.

It is significant that the outer edges of the flanges 42, 40 comprise parts which are parallel to the respective side walls 14, 16 as indicated at **68*a*, 70*a*. However, at the indented portions 54, 66 the outer edges of the flanges comprise parts which are cut away as indicated at 68*b*, 70*b*. The part 68*b* lies in a plane which passes through the junction line 24 and a line 76 defined by the junction of the shoulder 52 with the part 68*a*. Similarly, the part 70*b* lies in a plane which passes through the junction line 26 and a line 78 defined by the junction of the shoulder 64 with the part 70*a***. The significance of this will be explained.

The recesses 49, 60 comprise parts 50*a*, 62*a* in which the depth thereof is relatively small, being in the present example equal to the thickness of the flanges 40, 42. However, adjacent the junction of the side walls 12, 18 the recesses intersect at a common end portion 70 where the faces 50, 62 are indented and intersect; i.e. at the end portion 70 the depth is greater than it is in the regions 50*a*, 62*a*.

The block is substantially symmetrical about a plane which passes through the junction lines 20, 22. In particular, the flanges are substantially mutually identical and the recesses are also substantially mutually identical, save that they are handed, one being a mirror image of the other in each case. Furthermore the recesses 49, 60 and the flanges 40,42 are of substantially equal width. Similarly the parts 50*a*, 62*a* of the recesses and the parts 40*a*, 42*a* of the flanges are of substantially equal depth so that the inner faces of the parts 40*a*, 42*a* of the flanges and the faces of the parts 50*a*, 62*a* of the flanges lie in a common flat plane. And further, the depth of the common end portion 70 of the recesses is substantially equal to the distance between the inner faces of flange portions 54, 66 and the outer faces of the flange portions 40*a*, 42*a*.

Figure 6:
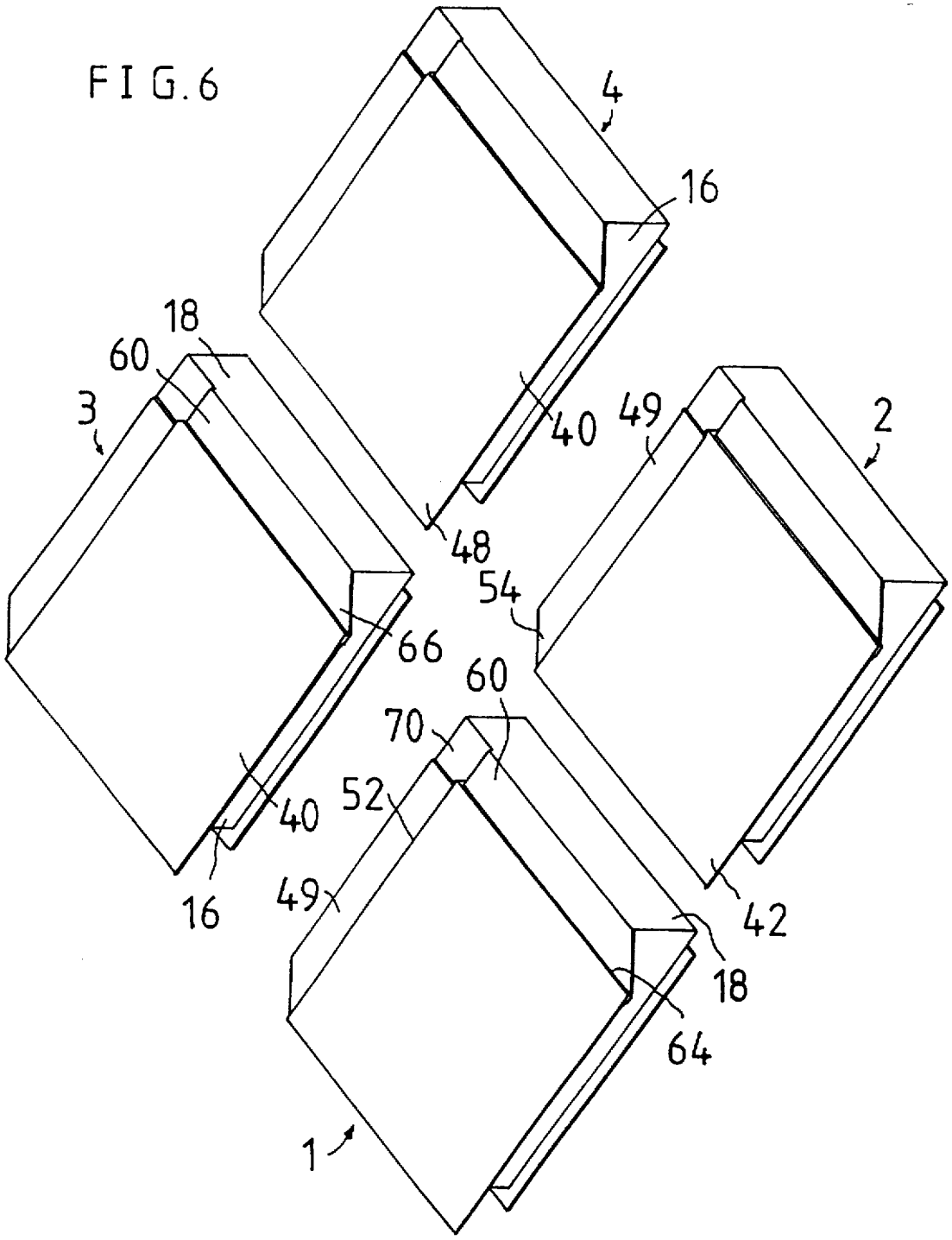
FIG. 6 is an exploded view of ajoint between four of the blocks, about to be joined together as shown in FIG. 3.
Figure 11:
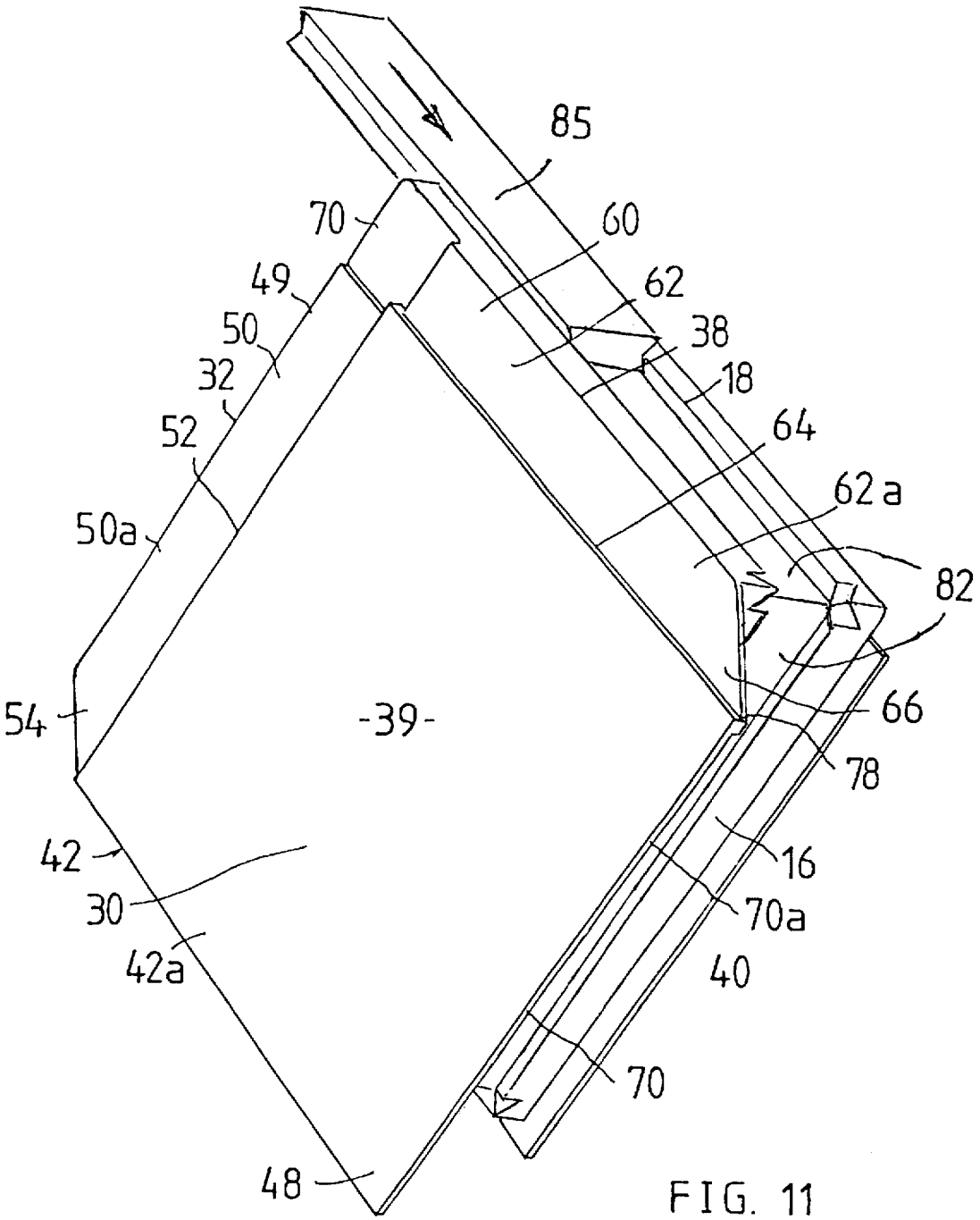
FIG. 11 is a somewhat schematic illustration of the building block shown in FIG. 2, and including formations on the first and second sides in registry for insertion of a joining member therein.

This geometrical arrangement has important consequences which are best explained with reference to FIG. 6. Four identical blocks 10 are illustrated in FIG. 6 but, in the description which follows, it is convenient to refer to them as blocks 1, 2, 3 and 4 respectively. To save repetition it is also convenient to distinguish identical components of the blocks from one another by placing the number of the block in brackets after the reference numeral which identifies a component of that block. Thus, for example, the number 16(1) would refer to the side wall 16 of the block 1 while the number 16(2) refers to the side wall 16 of the block 2.

Considering first that the block 1 is already in place in a structure such as a wall, the block 2 can be laid against it with the side wall 14(2) mated up against the side wall 18(1). In this position, the flange 42(2) fits neatly into the recess 60(1) with the outer edge of flange 42(2) mating against the shoulder 64(1). Significantly, the indented portion 54(2) of flange 42(2) is neatly received in the indented end portion 70(1), occupying the right hand half thereof. It is also of significance that the only part of the interface between the side walls 14(2) and 18(1) which is not covered by the flange 42(2) is at the extreme left hand end of the interface. As will be seen however, this edge is in due course also covered.

When the block 2 is in place, the block 3 is laid against the block 1 with the side wall 16(3) mated up against the side wall 12(1). In this position, the flange 40(3) fits neatly into the recess 49(1) with the outer edge of flange 40(3) mating against the shoulder 52(1). The indented portion 66(3) of flange 40(3) is also neatly received in the indented end portion 70(1), occupying the left hand half thereof. Again, the only part of the interface between the side walls 16(3) and 12(1) which is not at this stage covered by the flange 40(3) or 40(2) is at the extreme right hand end of the interface.

When the block 3 is in place, the block 4 is laid against the blocks 2 and 3 with the side walls 16(4) and 14(4) respectively mated up against the side walls 12(2) and 18(3). In this position, the flanges 40(4) and 42(4) respectively fit neatly into the recesses 49(2) and 60(3). The intersecting end portion 48(4) of the flanges 40(4) and 42(4) overlies the joint between the indented portions 54(2) and 66(3) and thus also the aforementioned ends of the interfaces between the sidewalls 14(2), 18(1) and 16(3), 12(1).

By continuing to lay further blocks in this way a wall can be constructed in which the entire interface between any two blocks is completely covered by the flanges of the surrounding blocks.

The fact that the flanges 40, 42 of one block 10 fit closely in the recesses 49, 60 of adjacent blocks has the result that, when the blocks are fitted together, the outer faces 40*a*, 42*a* of the flanges are flush with the outer faces of the blocks. Where, as in the present example, the outer faces of the blocks are flat, the outer face of the entire construction is also flat.

The term "complemental" when used herein in connection with the interrelationship of the flanges 40, 42 and the recesses 60, 49 is not intended to imply that it is essential that the flanges 40, 42 should be an exact fit in the recesses 49, 60. It is however considered essential that the faces 50, 62 of the recesses and the inner faces 40*a*, 42*a* of the flanges should be located at substantially equal distances from the outer face 39 of the block. This ensures that, in a construction in which such blocks are laid, they will all be at a constant distance from a plane of reference or datum. In combination with this, the configuration of the intersecting ends of the flanges 40, 42 and recesses 59, 60, as discussed above, ensures at the same time that no part of an interface between any of the blocks is exposed directly to the exterior the construction. The interfaces are thus shielded from the elements and in particular from the rain.

Within these limitations, the flanges 40, 42 may thus be narrower than the recesses as long as the flanges are wide enough to overlie the interfaces between the blocks. The thickness of the flanges can also be less or greater than the depth of the recesses. However, if the thickness of the flanges is not substantially equal to the depth of the recesses, the flanges will not be flush with the outer faces of the blocks.

What has been described to this point is a basic version of one example of the invention. Various modifications are envisaged, some of which will now be described.

The faces of the flanges and recesses need not be flat or mutually parallel.

The flanges and recesses may be set in from the outer edges of the side walls.

The outer faces of the blocks need not be flat. They could be curved or provided with three-dimensional patterns having a decorative or functional purpose.

The side walls of the block 10 define a cavity 88 which opens to the inner face of the block but is closed to the outer face by the cross wall 30. The cavity substantially reduces the weight of the block and can be used to accommodate insulating material and fittings for services such as plumbing and electricity in the finished construction. It can also filled with mortar, concrete or plaster in the finished construction. The provision of a cavity is not however essential and the block may be of solid construction.

As shown in FIGS. 1 and 2, the side walls 14, 16 may each be provided with inner flanges 90, 91. These flanges 90, 91 are advantageously parallel to the respective outer flanges 42, 40 and located along the inner edges 92, 94 of the side walls 14, 16. The side walls 18, 12 of adjacent blocks in a structure fit closely between the flanges 42, 90 and 40, 91 and the flanges serve to lock the blocks together, preventing lateral movement of any of the blocks; i.e. movement in an inward or outward direction.

In the present example, the inner flanges 90, 91 stand proud of the inner faces of the blocks although this is not essential. Furthermore, recesses are not provided in the blocks for receiving the inner flanges 90, 91 but such recesses can be provided if necessary. Also, it is not essential that the inner flanges should extend along the full length of the side walls 18, 12. These features are desirable especially where solid blocks are used and the inner face of the construction is required to be substantially flat without necessitating the use of plaster, for example.

Referring to FIG. 7, the blocks can also be arranged to be locked together by forming the block with each flanged side wall sloping inwardly (towards the centre of the block) from its inner edge to its flanged outer edge as shown at 94, and with each of the opposing side walls sloping complementally outwardly from its inner edge to its recessed outer edge as shown at 96.

When blocks having the inner flanges 90, 91 are used to form a construction, it is necessary to lay them in order, starting from an end of the construction since each block must be offered up to another side wall to side wall. In some cases it may be considered best to use blocks which are not provided with the inner flanges or the other features discussed above which, while they serve to lock the blocks together laterally, prevent one block from being offered up to another from a lateral direction and also prevent a block which has been laid from being removed in a lateral direction.

In many cases it may not be necessary to provide any means of joining the blocks together. However, where necessary, a variety of means alternative or additional to those already described may be used to join the blocks together. They may be glued together by means of a suitable adhesive located between the interfacing side walls. This is a particularly suitable method of joining together blocks which are made of plastics material or even masonry. In another alternative, holes 80 indicated for the purposes of illustration in dotted outline in FIG. 2 may be formed in the side walls. These holes are in register when the blocks are placed against one another. The blocks can be joined together by means of rivets, bolts or other fasteners which pass through the holes 80, the heads of the rivets (or the bolts and the nuts which are screwed thereto) bearing on the inner faces of the side walls, for example.

In one modification of this arrangement, the holes 80 may be used for the reception of reinforcing rods which can extend along the entire height or length of the wall or other structure which is built with the blocks. In this case the cavities 88 can be filled with cement, concrete or other suitable filler which binds the reinforcing rods and the blocks together after the blocks are laid.

In yet another alternative shown in FIG. 8, at least one recess 82 may be formed in the outer face of each of the side walls. In the example illustrated, each recess comprises a base 83 which is set in from the outer face of the side wall but is parallel thereto. A shoulder 84 rises from each end of the base to join the outer face. The shoulders are canted towards each other so that the length of the mouth of the recess 82 is less than that of the base. The recesses are positioned so that, when the blocks laid, the recesses in each pair of abutting side walls are in register. The blocks can be locked together by means of a keying element 85 having a pair of long faces 86 which are joined at each end by a pair of V-shaped end faces. The cross sectional shape of the element 85 is complemental to that of a pair of the recesses 82 located mouth to mouth as happens when the blocks are laid in a structure. Thus, when a keying element 85 is inserted in such a pair of recesses, the end faces of the element 85 interengage with the shoulders 84 of the recesses, thereby locking the two blocks together.

This latter example of an interlocking arrangement is particularly useful when block s are used which do not have an impediment such as the inner flanges 90 to being placed in position from a lateral direction as discussed above, because the keying elements 85 can be inserted in the recesses 82 also from the lateral direction. However, the use of recesses such as 82 in combination with keying elements such as 85 is not limited to such blocks.

Figure 9:
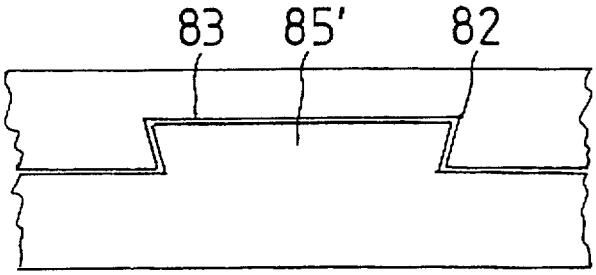
FIG. 9 is a third fragmentary view of two blocks with modified side walls joined together by a keying element integrally moulded in one of the side walls.

In a modification of the latter embodiment, illustrated in FIG. 9, the recesses 82 are provided in only two of the side walls, say 12, 18. The other two side walls 14, 16 are provided with integrally formed keying formations 85' which engage the shoulders 84 of the recesses 82 in the side walls 12, 18 of adjacent blocks.

In yet another modification, the each side wall is provided with one or more recesses such as 82 and one or more complemental projections such as 85'.

A useful feature of the block 10 as shown is the provision of pairs of flat internal panels 100, 102. The panels 100 have a small gap 104 between them which is aligned with the junction lines 20, 22. Similarly, the panels 102 have a small gap 106 between them which is aligned with the junction lines 24, 26. However, it may be noted that the panels are joined together where they cross and also at their ends. This helps to stiffen them and also to stiffen the block as a whole. The block may be cut in two diagonally along the junction lines 20, 22 by means of a saw inserted in the gap 104. Similarly, the block may be cut in two diagonally along the junction lines 24, 26 by means of a saw inserted in the gap 106. In both cases the gap acts as a guide for the saw. The half. blocks so produced are used at the boundaries of the construction. Considering the block shown in FIG. 1 to be upright and for use in a wall, the upper halves of the blocks cut along the gap 106 will be used along the bottom of the wall and the lower halves will be used along the top of the wall. Similarly, the right hand halves of a block cut along the gap 104 will be used along one end of the wall and the left hand halves will be used along the opposite end of the wall. Wastage is thus reduced.

It is not essential that the side walls of the blocks should be disposed in a square. An advantage of the square disposition is that, when the blocks are used to construct a wall, it is easy to position them in the orientation shown in FIGS. 3 and 6, i.e. with the intersecting ends of the flanges 40, 42 of each block vertically below the intersecting ends of the recesses. This is the optimum orientation for minimising the risk that water will migrate upwardly at the interfaces between the flanges and the recesses. The blocks could however, be shaped so that their side walls are disposed in a rectangle. In another alternative, the block could be provided with, for example, six or eight side walls disposed respectively in a hexagon or octagon. A block with hexagonally disposed side walls is shown in FIG. 10. Here, three intersecting flanges 100, 102, 104 project from three of the side walls of the block and three complemental intersecting recesses 106, 108, 110 are formed in the opposing side walls of the block. The middle flange 102 is wider than the outer two flanges 100, 104 and the middle recess is similarly wider than the outer recesses 106, 110. The recesses 106 and 110 are continued over the indented end portions 112, 114 of the flanges 104, 100 respectively. The corresponding indented portions 112, 114 of the flanges of adjacent blocks are received in the indented parts 116, 118 where the recesses 1 10, 108 and 106, 108 respectively intersect.

It is not essential that the side walls be flat. In one variant they may be complementally corrugated so that the corrugations in the side wall of one block are a neat fit in the corrugations in the interfacing side wall of an adjacent block. This helps the blocks to interlock. The corrugations are also useful in taking up thermal expansion or contraction of the blocks. For this purpose, it may be beneficial to provide similar corrugations in the internal panels. Similarly it may be beneficial to provide the cross wall with a domed or pyramidal shape which enables it to flex laterally to take up thermal expansion or contraction.

As long as the joints between the blocks are completely covered by the overlying flanges, it is not essential that the interfacing side walls of adjacent blocks be congruently shaped or in close face-to-face relationship along their entire lengths. It is however considered desirable that the interfacing side walls should be shaped so that they contact each other and thus support each other in the finished construction.

The block 10 is symmetrical about a plane through the junction lines 20, 22. An advantage of this symmetricity is that both halves of the block which is cut in two at the plane of symmetry can be used, as already noted. The hexagonal blocks are symmetrical about a plane indicated by the dotted line 120 and might be provided with pairs of panels (corresponding to the panel pairs 100, 102 in the block 10) which span the block adjacent the plane 120 and a second plane 122 which is perpendicular thereto.

The width of the box 10 illustrated is 90 mm. Its diagonal length is 600 mm and the length of each side wall (excluding flanges) is 424.26 mm. The width of the outer flanges is 50 mm and that of the inner flanges is 25 mm. The blocks of the invention are not limited to these dimensions which are examples only of a block which is moulded of a plastics material. The dimensions of the block would be adjusted so that they are compatible with standard dimensions as used in existing housing, which dimensions are usually based on a 600 mm least-common-multiple unit. Clearly the dimensions, particularly such dimensions as wall thicknesses, would be varied to suit the material of which the blocks are constructed.

Figure 3:
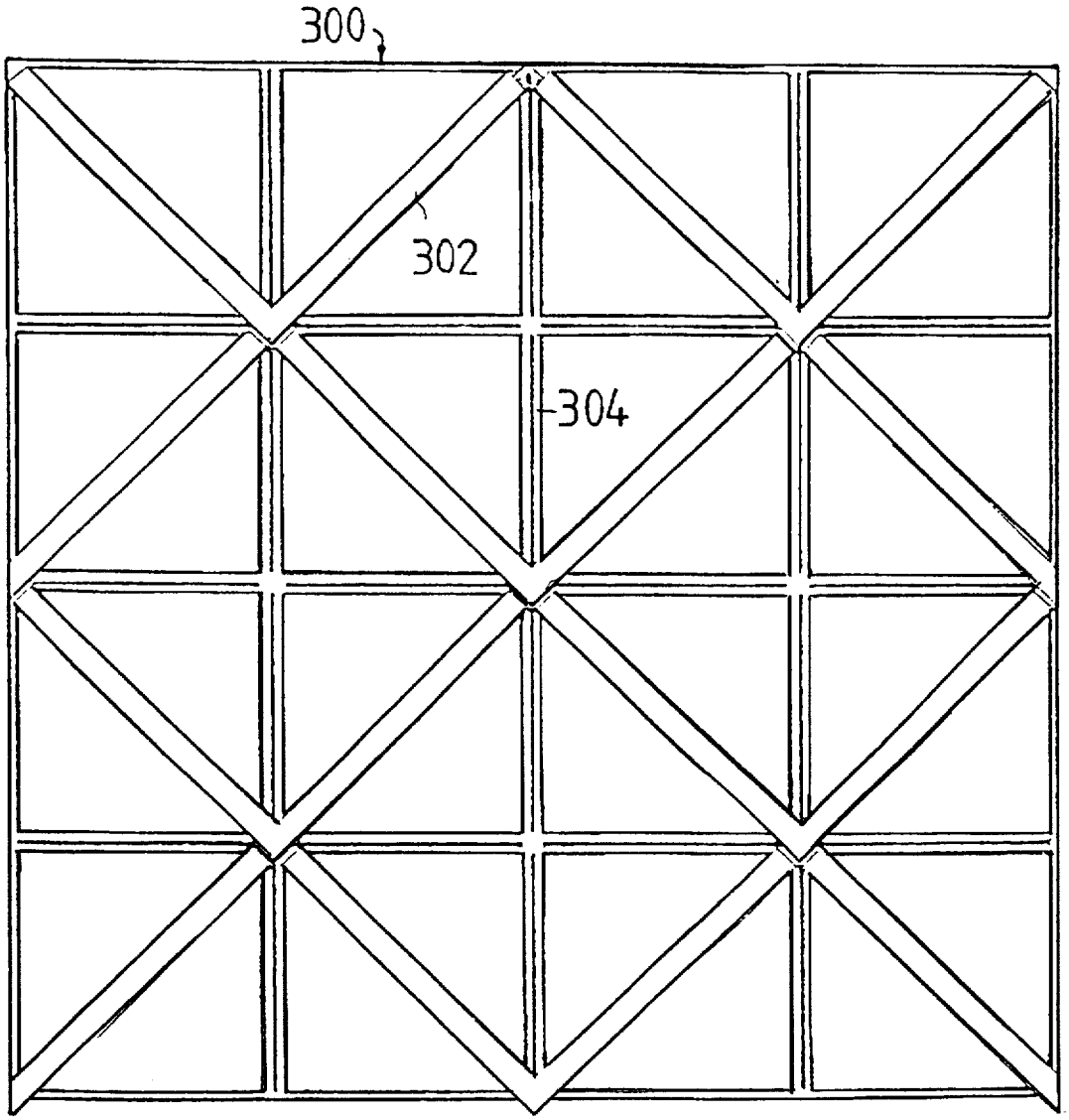
FIG. 3 is an illustration of a structure made up of the blocks shown in FIGS. 1 and 2, which structure may constitute a wall, roof, or floor panel and is viewed from an inner side thereof.

FIG. 3 illustrates the interior of a wall 300, and shows how the side walls form diagonal bracing 302 while the inner panels form secondary bracing 304 along perpendicular and horizontal axes.

Figure 4:
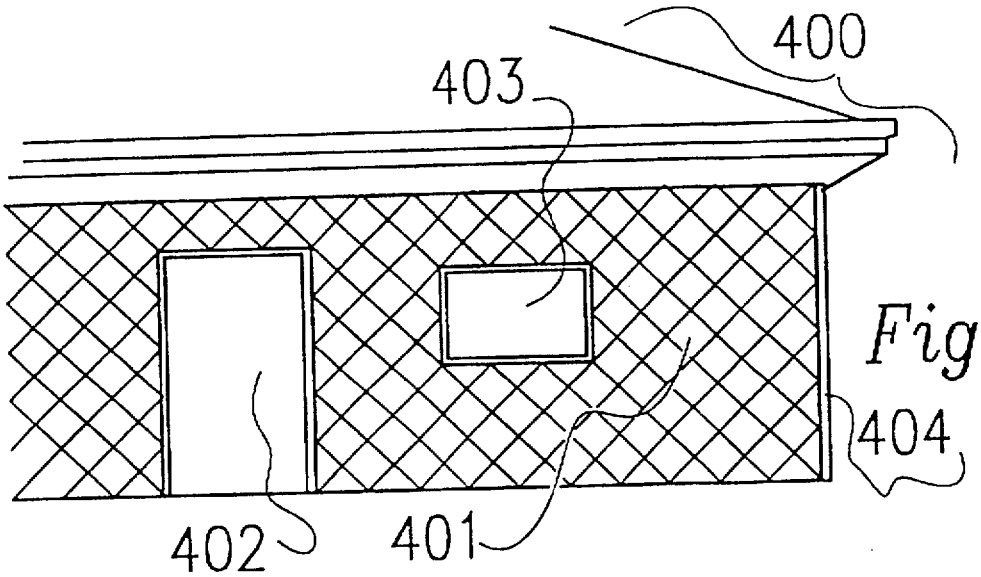
FIG. 4 is a schematic illustration of a house wall from outside.

FIG. 4 illustrates a part of a house wall 400 constructed of the blocks 10—the profile of each block being indicated by the diagonal array of lines.

One option for the manufacture and supply of blocks is to provide larger modular blocks that are for example 2 units×1 unit, 2×2, 4×1, and other similar multiples so that assembly on site can be minimised. A computer procedure may be used in order to provide an optimised list of components for a building of a particular design.

The interiors of walls and other constructions made of open-box type blocks are not particularly appealing in their raw state, but it is an advantage to provide them in this form so that, as already noted building services and insulation may be located in the cavities. Thereafter, a lining board of suitable type may be applied to the inner surface. The board may be applied by adhesives or screws.

FIG. 4 shows a part of a wall 401 of a house 400 from the outside, in which the characteristic diamond-shaped pattern formed by the sloping edges of the individual modular blocks is visible. A window 403 and a door 402 are lined by the cut edges of half-blocks made on the site by splitting the blocks as already noted.

Figure 5:
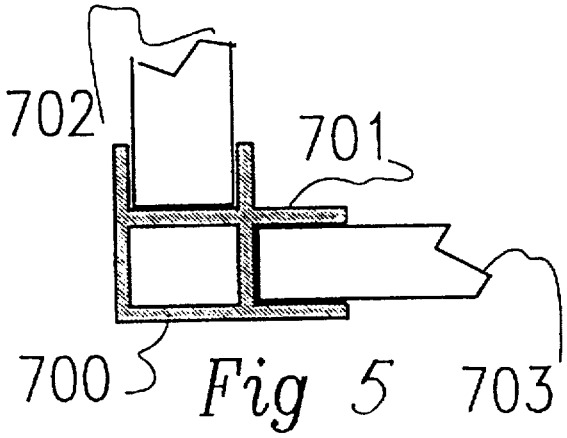
FIG. 5 is a cross sectional illustration of a corner post.

FIG. 5 illustrates a corner column according to the present invention, for finishing off an exterior corner (such as 404). The column 700 comprises a length of extruded aluminum or the like, with two channels at right angles to each other located on two adjacent sides of a box section. Walls 702, 703 made of blocks 10 may be fixed in the channels in any suitable manner. Other configurations of extruded aluminium may be used where walls meet end to end, where three walls meet, and so on.

As a variation a block may be provided having dimensions equal to one tenth of those of the standard block. This smaller block is useful for those who make architectural models and also may provide a childrens' play block for making (for example) dolls houses or any other kind of construction. Blocks of other sizes, not necessarily related to the above modular standard size, may be provided.

Alternatives to the block shapes already discussed include:

(1) rectangles wherein the longer side is an integer multiple of the shorter side, in order to reduce labour costs when assembling larger constructions, (2) other interlocking polyhedral shapes such as diamonds (parallelograms), octagons and even triangles;

(3) curved or re-curved shapes such as complementary S-curves, and filleted rectangles.

Filling channels suitable for the pressure injection of an adhesive from a surface of an assembled wall may be provided.

The materials for making these blocks include recycled plastics, concrete, ceramics, glass and pressed metal. The blocks may also be fabricated from wood or paper- or wood-based parts. Fabrication costs may be reduced by automation.

The adhesive or cement, when used should of course be appropriate for the materials from which the blocks are constructed. Preferably the adhesive or cement is waterproof. It could be a conventional adhesive for ceramics or glass or concrete-based blocks. It may be a two-part adhesive or a solvent cement for plastics blocks.

ADVANTAGES

Advantages of this type of block include:

relatively high strength for a given mass of material;

interlocking, easy-draining construction;

speed of assembly whereby stiff, stable modular panels for floors, walls, or roofs can be quickly constructed.

At the present time it is considered likely that blocks having a square configuration similar to the blocks 10 will be the most practical and that it is unlikely that triangular blocks similar to those formed by splitting the blocks 10 diagonally as described will have much commercial use except in conjunction with the square blocks. In this connection the triangular blocks are useful to fill in the triangular spaces at the boundaries of a construction formed from the square blocks. In some constructions, rather than splitting the square blocks, it may be more economical to provide moulded triangular blocks.

One particular application for the blocks is in the construction of storm-resistant housing and relief housing in disaster areas, where the components may be flown in.

I claim:

1. A building block comprising spaced apart first and second sides and spaced apart third and fourth sides which are disposed transversely to the first and second sides, the block intended to be used to construct a structure made up of a number of such blocks disposed side to side with other blocks in the structure, the block comprising:

a first flange which extends along the first side and projects outwardly therefrom away from the second side;

a second flange which extends along the third side and projects outwardly therefrom away from the fourth side;

a first recess which extends along and adjoins the second side, projecting inwardly therefrom towards the first side and having a shape complementary to the first flange, a second recess which extends along and adjoins the fourth side, projecting inwardly therefrom towards the third side and having a shape complementary to the second flange; and wherein the first flange intersects the second flange at a position located outwardly of a junction between the first side and the third side;

adjacent a junction between the first side and the fourth side, the first flange comprises a first portion which spans the second recess and has an outer face in which an indentation is formed which is aligned with the second recess; and adjacent a junction between the second side and the third side, the second flange comprises a second portion which spans the first recess and has an outer face in which an indentation is formed which is aligned with the first recess.

2. A building block according to claim 1, wherein the first and second portions have a predetermined thickness, and adjacent a junction between the second side and the fourth side, the recesses intersect at a zone in which they comprise a common indentation which has a depth which is at least equal to the thickness of the first and second portions.

3. A building block according to claim 1, wherein the first and second sides are mutually parallel, and the third and fourth sides are disposed at right angles to the first and second sides.

4. A building block according to claim 1, wherein all the sides are of substantially equal length.

5. A building block according to claim 4, wherein the block is symmetrical about an imaginary plane of symmetry which passes through a junction between the first side and the third side, and a junction between the fourth side and the second side.

6. A building block according to claim 1, wherein the flanges comprise outer faces, a portion of each of which is coplanar with an outer face of the block.

7. A building block according to claim 1, wherein the flanges and the recesses are of substantially equal length, and are disposed at right angles to one another in a substantially square configuration.

8. A building block according to claim 7, wherein the first portion of the first flange which spans the second recess has an outer edge which is located in or inside an imaginary plane which passes through the junction between the first side and the fourth side, and intersects the first side at an angle of 45°, and the second portion of the second flange which spans the first recess has an outer edge which is located in or inside an imaginary plane, which passes through the junction between the second side and the third side, and intersects the third side at an angle of 45°.

9. A building block according to claim 8, wherein a portion of the outer edge of the first flange is parallel to the first side and intersects the first portion which spans the second recess at an angle of 135°, and a portion of the outer edge of the second flange is parallel to the third side and intersects the second portion which spans the first recess at an angle of 135°.

10. A building block according to claim 1, wherein the first and second flanges are respectively located adjacent outer edges of the first and third sides, and the block comprises a third flange, which is spaced from the first flange and extends along the first side, projecting outwardly therefrom away from the second side, and a fourth flange which is spaced from the second flange and extends along the third side, projecting outwardly therefrom away from the fourth side.

11. A building block according to claim 10, wherein the third flange is located adjacent an inner edge of the first side and the fourth flange is located adjacent an inner edge of the third side.

12. A building block according to claim 11, wherein the third flange is parallel to the first flange and the fourth flange is parallel to the second flange.

13. A building block according to claim 12, wherein the third flange and the fourth flange have inner faces which are coplanar.

14. A building block according to claim 1, wherein the block comprises a cavity defined by outer walls disposed about the periphery of the block and having outer faces constituting the sides of the block.

15. A building block according to claim 14, wherein the cavity is spanned by a least one inner wall, which is disposed diagonally across the cavity.

16. A building block according to claim 1, wherein the sides are substantially flat.

17. A building block according to claim 1, wherein formations are provided in the first side and the second side which are shaped and positioned so that, when the first side of the block is face to face with the second side portion of an identical block, the formations interengage to join the blocks together.

18. A building block according to claim 1, wherein formations are provided in the first side and the second side which are shaped and positioned so that, when the first side of the block is face to face with the second portion of an identical block, the formations are in register for insertion of a joining member therein which joins the blocks together.

19. A building block according to claim 1, wherein the block is of a moulded plastics material.

20. A construction constructed at least partly from building blocks as claimed in claim 1, wherein each block is oriented so that each of the four sides is at an angle to a horizontal with the second and fourth sides being located above the first and third sides, and the flanges overlying interfaces between the first and third sides, and the second and fourth sides of the blocks therebelow, said flanges being located in the recesses adjoining the second and fourth sides of said blocks located therebelow.

* * * * *